US008617380B2

(12) United States Patent
Wong et al.

(10) Patent No.: US 8,617,380 B2
(45) Date of Patent: Dec. 31, 2013

(54) ELECTROPOLISHING SOLUTION CONTAINING A WATER SEQUESTERING AGENT AND METHODS OF USE THEREOF

(75) Inventors: Sophia L. Wong, Milpitas, CA (US); Nicholas R Haluck, San Jose, CA (US); Patrick C Vien, San Jose, CA (US)

(73) Assignee: Abbott Cardiovascular Systems, Inc., Santa Clara, CA (US)

( * ) Notice: Subject to any disclaimer, the term of this patent is extended or adjusted under 35 U.S.C. 154(b) by 148 days.

(21) Appl. No.: 13/271,860

(22) Filed: Oct. 12, 2011

(65) Prior Publication Data

US 2013/0092557 A1 Apr. 18, 2013

(51) Int. Cl.

| | |
|---|---|
| ***C25B 15/00*** | (2006.01) |
| ***C25F 3/16*** | (2006.01) |
| ***C25F 7/02*** | (2006.01) |

(52) U.S. Cl.

USPC ..... 205/673; 205/675; 205/684; 204/232

(58) Field of Classification Search

USPC ..... 205/640–868; 204/232–241

See application file for complete search history.

(56) References Cited

U.S. PATENT DOCUMENTS

| | | | | |
|---|---|---|---|---|
| 6,375,826 | B1 * | 4/2002 | Wang et al. | 205/684 |
| 7,771,581 | B2 * | 8/2010 | Callol et al. | 205/640 |
| 2007/0209947 | A1 * | 9/2007 | Shrivastava et al. | 205/662 |
| 2011/0062031 | A1 * | 3/2011 | Wulf | 205/676 |
| 2013/0092554 | A1 | 4/2013 | Wong et al. | |
| 2013/0092556 | A1 | 4/2013 | Wong et al. | |

* cited by examiner

*Primary Examiner* — Nicholas A Smith
*Assistant Examiner* — Brian W Cohen
(74) *Attorney, Agent, or Firm* — Workman Nydegger; John Kwok

(57) ABSTRACT

Substantially anhydrous electropolishing electrolyte solutions. The substantially anhydrous electropolishing electrolyte solutions described herein do not use water as a solvent; instead, such electropolishing electrolyte solutions use anhydrous alcohols and/or glycols as a solvent. For example, an electropolishing electrolyte solution, as described herein, may include an alcohol, at least one mineral acid, and at least one water sequestering agent. Suitable examples of water sequestering agent include, but are not limited to, polyfunctional alcohols. Methods of electropolishing metal articles using such electropolishing electrolyte solutions are disclosed herein as well.

15 Claims, 4 Drawing Sheets

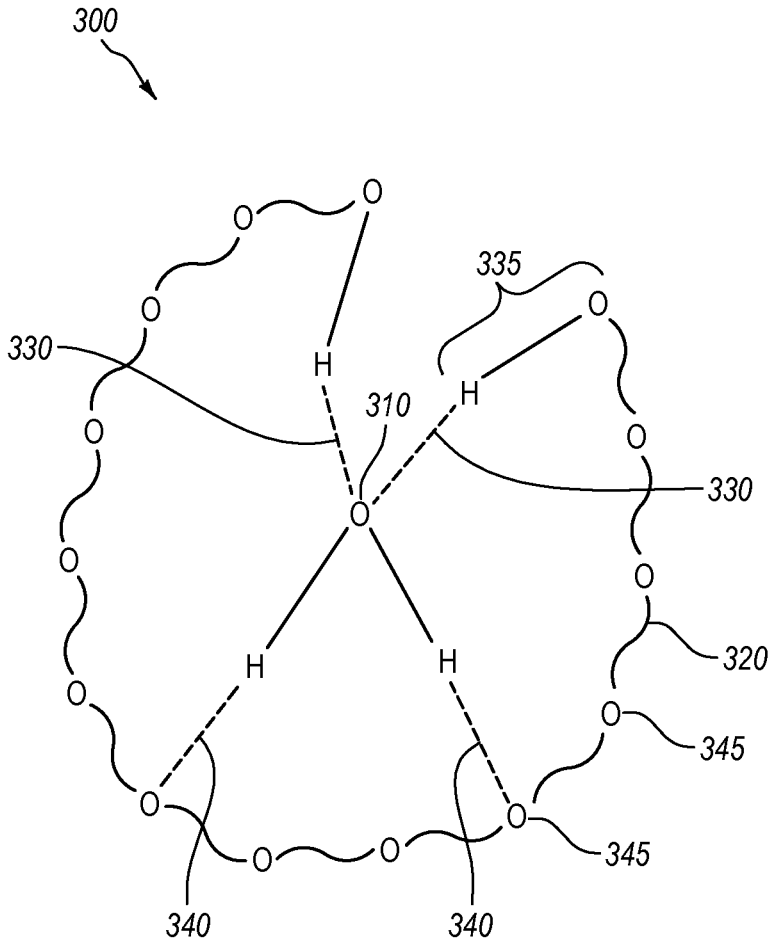
300
O
O
O

ELECTROPOLISHING SOLUTION CONTAINING A WATER SEQUESTERING AGENT AND METHODS OF USE THEREOF

BACKGROUND

The present disclosure relates generally to electrolyte solutions that can be used for electropolishing articles made from metals, and in particular, for electropolishing metallic medical devices (e.g., stents, closure devices, and the like) made of stainless steel, titanium, tungsten, nickel-titanium, tantalum, cobalt-chromium-tungsten, tantalum-nickel-tungsten, etc. While the electrolyte solutions described herein are mainly applicable to metallic medical devices, the disclosure is not limited to such medical devices. For example, the methods may be applied to electropolish metallic automotive or aerospace components.

Electropolishing is an electrochemical process by which some of the surface metal is electrolytically dissolved. In general, the metal article (e.g., a stent) is connected to an anode and connected to a power supply while immersed in an electrolyte solution. A metal cathode connected to the negative terminal of the power supply is also included in the electrolyte solution. Metal is removed from the anode surface by the action of the current and the electrolyte solution as current flows from the metal article (as the anode) to the cathode. The rate at which metal is dissolved from the metal article is controlled, at least in part, by the applied current and/or voltage, the positioning of the cathode relative to the metal articles, and/or distribution of the electrolyte around the article. According to the theory of electropolishing, the current density is highest at high points protruding from a surface and is lowest at the surface low points. Thus, the higher current density at the raised points causes the metal to dissolve faster at these points which thus levels the surface.

Stents are generally tube-shaped intravascular devices placed within a blood vessel to maintain the patency of the vessel and, in some cases, to reduce the development of restenosis. Stents may be formed in a variety of configurations which are typically expandable since they are delivered in a compressed form to the desired site. Example stent designs include, but are not limited to, helically wound wire, wire mesh, weaved wire, serpentine stent, a chain of rings, or laser cut tubular stents. The walls of stents are typically perforated in a framework design of wire-like connected elements or struts or in a weave design of cross-threaded wire. Some stents are made of more than one material. The stent may be, for example, a sandwich of metals having outer layers of a biocompatible material, such as stainless steel, with an inner layer providing the radioopacity to the stent needed for tracking by imaging devices during placement. In forming such stents from metal, a roughened outer surface of the stent may result from the manufacturing process (e.g., from processes such as tube drawing and laser cutting).

It is desirable for the surface of the stent to be smooth so that it can be easily inserted and traversed with low friction through the blood vessels toward the site of implantation. In addition, a rough outer surface may also damage the lining of the vessel wall during insertion. Furthermore, smooth surfaces decrease the probability of thrombogenesis and corrosion. Likewise, stents having a smooth, mirror-like finish generally have a better fatigue life because surface defects (scratches, burrs, inclusions, and the like) can be sites for crack propagation.

Since the processing to form metallic stents often results in a product initially having undesirable burrs, sharp ends or debris and slag material from melting the metal during processing, mechanical cleaning (e.g., interior and exterior grinding), chemical cleaning (e.g., descaling), or the like are generally performed. Following cleaning, further surface treatment such as electropolishing is generally performed. Electropolishing is able to provide a mirror-like, defect-free surface to the metal article (e.g., the stent).

BRIEF SUMMARY

The present disclosure relates to a substantially anhydrous electropolishing electrolyte solution that includes a water sequestering agent that is capable of neutralizing water molecules that may be introduced into the electrolyte. The substantially anhydrous electropolishing electrolyte solutions described herein do not use water as a solvent; instead, such electropolishing electrolyte solutions use anhydrous alcohols, glycols, and the like as a solvent. For example, an electropolishing electrolyte solution, as described herein, may include an alcohol, at least one mineral acid, and at least one water sequestering agent. Methods of electropolishing metal articles using such electropolishing electrolyte solutions are disclosed herein as well. Such electropolishing electrolyte solutions and methods employing such electropolishing solutions may yield better electropolishing efficiency for a given voltage and current, increased longevity of the electropolishing electrolyte solution, and electropolished metal articles having substantially improved surface quality and uniformity.

In one embodiment, an electropolishing electrolyte solution is described. The electropolishing electrolyte solution includes an alcohol, at least one mineral acid, and at least one water sequestering agent. In one embodiment, the at least one water sequestering agent includes two or more hydrogen bond acceptors and two or more hydrogen bond donors. Examples of such compounds include, but not limited to, so called polyfunctional alcohols, such as polyethers (e.g., polyethylene glycol ("PEG") and polypropylene glycol (PPG)) and polyols (e.g., sugar alcohols). In one example, the water sequestering agent may be a PEG, such as PEG 1000 (i.e., a PEG with an average molecular weight of 1000 daltons).

Due to the fact that water can poison the electropolishing solution and reduce the ability of the solution to electropolish metal articles, the electropolishing electrolyte solution is substantially anhydrous. Water in the electropolishing electrolyte can also be broken down under electropolishing conditions (i.e., electropolishing conditions can cause electrolysis of water), which can lead to the formation of gas bubbles that can adhere to the surface of the articles being electropolished and harm surface quality. If water is introduced into the electropolishing electrolyte solution, the water sequestering agent is selected such that it is able to form multiple hydrogen bonds with water in the electropolishing electrolyte solution and thereby neutralize the water.

In one embodiment, the alcohol is substantially anhydrous (i.e., about 100% or absolute) methanol. One will appreciate, however, that other alcohols, glycols, and the like may be substituted for or used in combination with the methanol. Suitable examples of alcohols and glycols include, but are not limited to, ethanol, isopropanol, ethylene glycol, and propylene glycol.

In one embodiment, the mineral acid solution of the electropolishing electrolyte solution includes about 5 volume % ("vol %") to about 7 vol % sulfuric acid and about 3 vol % to about 14 vol % methanolic hydrochloric acid.

In a specific embodiment, the electropolishing electrolyte solution includes: about 79.5 vol % methanol, about 14 vol % concentrated methanolic hydrochloric acid, about 6.5 vol % concentrated sulfuric acid, and about 2 g to about 10 g (e.g., about 5 g) of PEG 1000 per approximately 2000 ml of the electropolishing electrolyte solution.

In another embodiment, a method for scavenging water in an electropolishing electrolyte solution is described. The method includes (1) positioning a substantially anhydrous electropolishing electrolyte solution in an electropolishing apparatus, (2) adding a first quantity of a water sequestering agent to the substantially anhydrous electropolishing electrolyte solution, and electropolishing a metal article in the substantially anhydrous electropolishing electrolyte solution in the electropolishing cell, wherein water evolved during the electropolishing process is sequestered by the water sequestering agent.

The methods described herein may further include electropolishing the metal article(s) at a substantially constant electrical current while monitoring voltage across the electropolishing cell, and adding a second quantity of the at least one water sequestering agent to the electropolishing electrolyte solution when the voltage exceeds a selected value. That is, as water is evolved as a by-product of the electropolishing process or as water is absorbed from the air, the capacity of the water sequestering agent may be exceeded. As the water concentration in the electropolishing electrolyte solution increases, the observed resistance of the solution may increase as the efficiency of the electropolishing process drops, leading to the need to increase the voltage in order to maintain a substantially constant current. As such, adding an additional quantity of the at least one water sequestering agent may be able to neutralize the excess water in the electropolishing electrolyte solution and thereby restore the electropolishing electrolyte solution.

These and other objects and features of the present disclosure will become more fully apparent from the following description and appended claims, or may be learned by the practice of the invention as set forth hereinafter.

BRIEF DESCRIPTION OF THE DRAWINGS

To further clarify the above and other advantages and features of the present disclosure, a more particular description of the embodiments of the invention will be rendered by reference to specific embodiments thereof which are illustrated in the appended drawings. It is appreciated that these drawings depict only illustrated embodiments of the disclosure and are therefore not to be considered limiting of its scope. The embodiments of the invention will be described and explained with additional specificity and detail through the use of the accompanying drawings in which:

FIG. 3 is a schematic illustrating sequestration of a water molecule by an example of a water sequestering agent;

DETAILED DESCRIPTION

The present disclosure relates to a substantially anhydrous electropolishing electrolyte solution that includes a water sequestering agent that is capable of substantially neutralizing water molecules that may be introduced into the electrolyte. The substantially anhydrous electropolishing electrolyte solutions described herein do not use water as a solvent; instead, such electropolishing electrolyte solutions use anhydrous alcohols, glycols, and the like as a solvent. For example, an electropolishing electrolyte solution, as described herein, may include an alcohol, at least one mineral acid, and at least one water sequestering agent. Methods of electropolishing metal articles using such electropolishing electrolyte solutions are disclosed herein as well. Such electropolishing electrolyte solutions and methods employing such electropolishing solutions may yield better electropolishing efficiency for a given voltage and current, increased longevity of the electropolishing electrolyte solution, and electropolished metal articles having substantially improved surface quality and uniformity.

Figure 1:
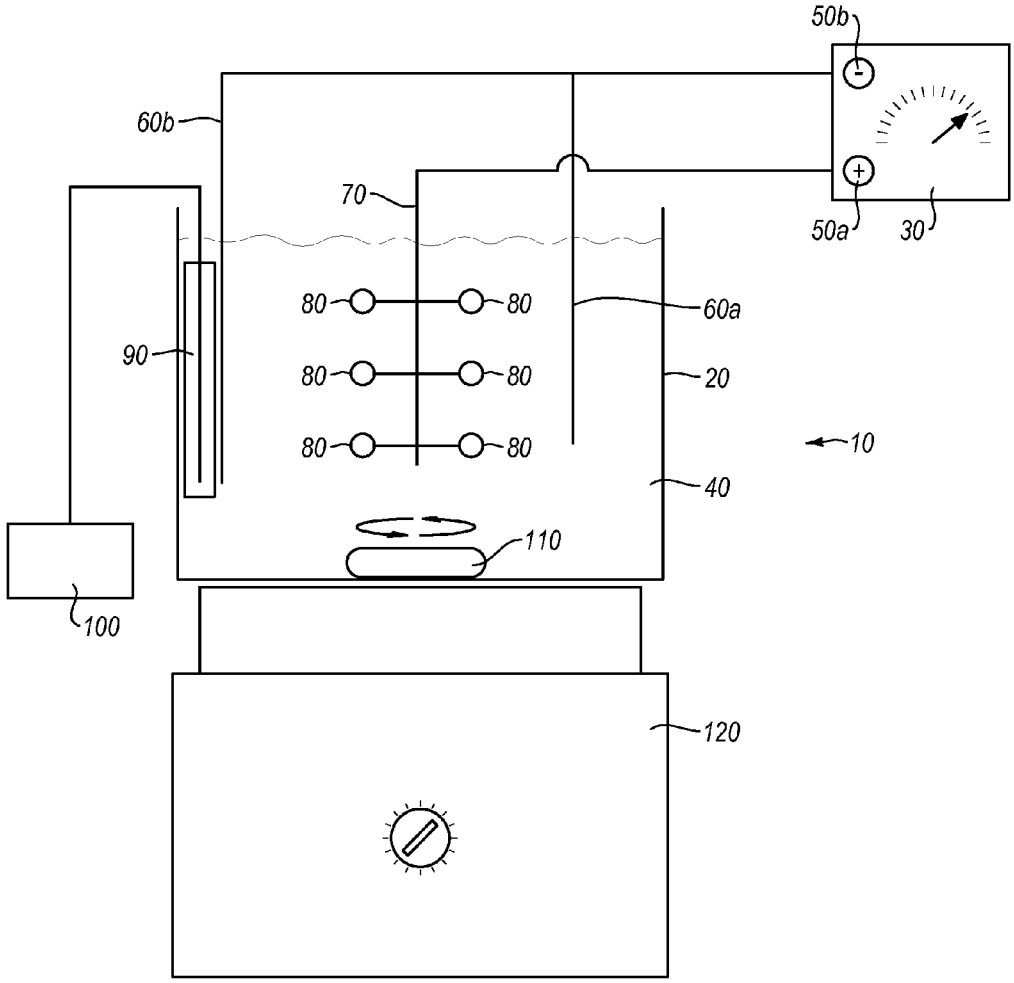
FIG. 1 is a schematic illustrating an electropolishing apparatus suitable for practicing the electropolishing embodiments described herein.

A schematic of a typical electropolishing apparatus 10 suitable for practicing the electropolishing embodiments described herein is illustrated in FIG. 1. The typical electropolishing apparatus 10 includes an electrolyte reservoir 20 that is configured to hold an electropolishing electrolyte solution 40. The typical electropolishing apparatus 10 further includes one or more cathode conductors 60*a* and 60*b*, an anode 70, and a direct current ("DC") power supply 30.

In the typical electropolishing apparatus 10, a number of metal work pieces 80 (e.g., stents) are electrically connected to the anodic (or positive) terminal 50*a* of the power supply 30 via anode 70, while the cathodic (or negative) terminal 50*b* of the power supply 30 is connected to cathodes 60*a* and 60*b*. The anode 70 and the cathode(s) 60*a* and 60*b* are connected to the DC power supply 30 and suspended in the reservoir 20 in the electrolyte solution 40. The anode 70 and the cathode 60*a* and 60*b* are submerged in the solution, forming a complete electrical circuit with the electropolishing electrolyte solution 40. A DC current is applied to the anode 70 and the cathode 60*a* and 60*b* to initiate the electropolishing process.

In the electropolishing methods described herein, for example, electropolishing is carried out with the electropolishing electrolyte solution 40 at or below about 0° C. due at least in part to the fact that the electropolishing process generates heat and the electropolishing electrolyte solution 40 can become unsafe if it is allowed to warm. As such, as further illustrated in FIG. 1, the electropolishing apparatus 10 may also include a combined temperature probe/heating and cooling unit 90, which is attached to a control unit 100. In the illustrated embodiment, the combined temperature probe/heating and cooling unit 90 is submerged in the electropolishing electrolyte solution 40. The control unit 100 may be programmed to monitor and control the temperature of the electropolishing electrolyte solution 40. Other configurations for monitoring/controlling the temperature of the electropolishing electrolyte solution 40 may be used in other embodiments.

The electropolishing apparatus 10 may also include a magnetic stir plate 120 and a magnetic stir bar 110 for mixing the electropolishing electrolyte solution 40 and ensuring even distribution of the electrolyte 40 around the workpieces 80 and the electrodes 60*a*, 60*b*, and 70. Other configurations for mixing the electropolishing electrolyte 40 may be used in other embodiments.

Figure 2A:
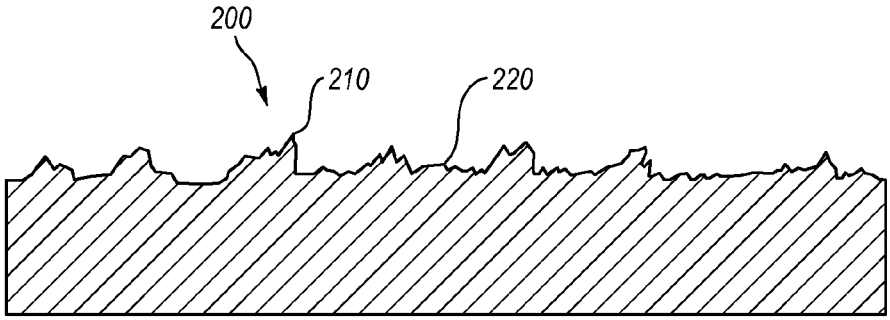
FIGS. 2A and 2B are schematic cross-sectional views illustrating the effect of electropolishing on surface finish.
Figure 2B:
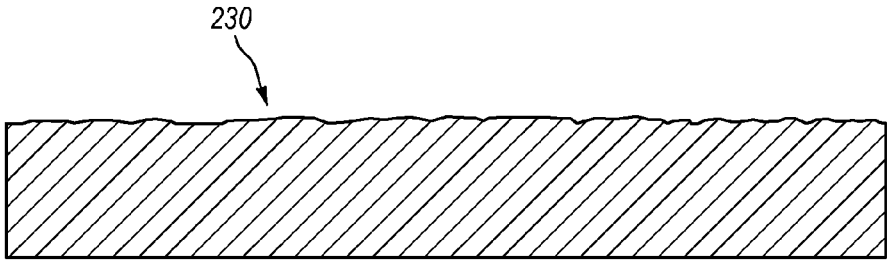

For a given electropolishing electrolyte solution, the quantity of metal removed from the work piece is proportional to the amount of current applied and the time. Other factors, such as the geometry of the work piece, affect the distribution of the current and, consequently, have an important bearing upon the amount of metal removed in local areas. For example, FIGS. 2A and 2B illustrate a surface 200 and 230 before and after electropolishing. Sharp regions, such as burrs and sharp edges, illustrated at 210 in FIG. 2A have higher current density than smoother areas illustrated at 220, which leads to the preferential removal of material from the sharp regions 210 and relatively little material removal from the smoother regions. The principle of differential rates of metal removal is important to the concept of deburring accomplished by electropolishing. Fine burrs have very high current density and are, as a result, rapidly dissolved. Smoother areas have lower current density and, as a result, less material is removed from these areas. The result of electropolishing is illustrated in FIG. 2B. As can be seen, the sharp regions illustrated at 210 in FIG. 2A are eroded away leaving a substantially flat, defect free surface 230.

In the course of electropolishing, the work piece is manipulated to control the amount of metal removal so that polishing is accomplished and, at the same time, dimensional tolerances are maintained. Electropolishing literally dissects the metal crystal atom by atom, with rapid attack on the high current density areas and lesser attack on the low current density areas. For most materials, the result is an overall reduction of the surface profile with a simultaneous smoothing and brightening of the metal surface.

Electropolishing produces a number of favorable changes in a metal work piece (e.g., a stent). These favorable changes include, but are not limited to, one or more of:

Brightening
Burr removal
Oxide and tarnish removal
Reduction in surface profile
Removal of surface occlusions
Increased corrosion resistance
Improved adhesion in subsequent plating
Removal of directional lines
Radiusing of sharp edges, sharp bends, and corners
Reduced surface friction
Stress relieved surface

Electropolishing Electrolyte Solutions

In one embodiment, an electropolishing electrolyte solution is described. The electropolishing electrolyte solution includes an alcohol, at least one mineral acid, and at least one water sequestering agent. In one embodiment, the at least one water sequestering agent includes two or more hydrogen bond acceptors and two or more hydrogen bond donors. Examples of such compounds include, but not limited to, so-called "polyfunctional alcohols," such as polyethers (e.g., polyethylene glycol ("PEG") and polypropylene glycol ("PPG")) and polyols (e.g., sugar alcohols). In one example, the water sequestering agent may be a PEG, such as PEG 1000 (i.e., a PEG with an average molecular weight of 1000 daltons).

In one embodiment, the at least one mineral acid may include about 3 volume % ("vol %") to 12 vol % sulfuric acid and about 0 vol % to about 30 vol % methanolic HCl; or about 6 vol % to 9 vol % sulfuric acid and about 7 vol % to about 28 vol % methanolic HCl; or about 6 vol % to 9 vol % sulfuric acid and about 12 vol % to about 20 vol % methanolic HCl. In another embodiment, the at least one mineral acid includes about 5 vol % to about 7 vol % sulfuric acid and about 3 vol % to about 14 vol % methanolic hydrochloric acid. In a specific embodiment, the electropolishing electrolyte solution includes about 79.5 vol % methanol, about 14 vol % concentrated methanolic hydrochloric acid, about 6.5 vol % concentrated sulfuric acid, and about 2 g to about 10 g (e.g., about 5 g) of PEG 1000 per approximately 2000 ml of the electropolishing electrolyte solution.

Conventional hydrochloric acid is made by dissolving hydrogen chloride gas in water. Most commercially available concentrated hydrochloric acid contains about 38 vol % of hydrogen chloride dissolved in water. The hydrochloric acid used in the electropolishing electrolyte solutions described herein is different. Instead of dissolving hydrogen chloride gas in water, the concentrated hydrochloric acid used herein is essentially anhydrous due to the fact that the hydrogen chloride gas is dissolved in methanol. Such acid is generally referred to as methanolic hydrochloric acid or methanolic HCl. Methanolic HCl is available commercially in a 3N solution. Hydrogen chloride gas can also be dissolved in other alcohols such as, but not limited to, ethanol and 2-propanol. Commercially available concentrated sulfuric acid is approximately 18.4 molar and is typically 95-98% pure. In a specific embodiment, the sulfuric acid (98%) is 18.4 M prior to mixing, which is diluted to 1.19 M once mixed in the final solution and the methanolic HCl is 3N prior to mixing, which is diluted to 0.42 M once mixed in the final solution. Electropolishing electrolytes containing other acids and acid mixtures depending on the metal or metals being electropolished.

Under electropolishing conditions (i.e., high voltage and high current), such a solution is able to degrade tantalum and tantalum alloys. For example, tantalum is removed from the solid metal structure according to the following reaction:

$$3SO_4^{-2}+12H^{+}+2Ta \rightarrow 3H_2SO_3+3H_2O+2Ta^{+3} \qquad \text{Formula 1}$$

As can be seen from Formula 1, water is evolved in the electropolishing process. In addition, alcohol solutions are naturally hygroscopic and, moreover, the electropolishing electrolyte solutions described herein are typically chilled below the dew point of atmospheric water while in use, which can further lead to the condensation of water in the electropolishing electrolyte solution. Nevertheless, the electropolishing electrolyte solution described herein is preferably anhydrous or substantially anhydrous. This is due to the fact that water can poison the electropolishing solution and reduce the ability of the solution to electropolish metal articles.

For example, when electropolishing articles fabricated from tantalum or a tantalum alloy (e.g., stent 400 or closure element 430 described in detail below), water is capable of poisoning the electropolishing solution because, under electropolishing conditions, tantalum can react with water to form an insulating oxide layer on the surface of the tantalum metal article.

Additionally, in many electropolishing electrolyte solutions, water is not used as the electropolishing electrolyte solution's solvent, but water is produced by the electropolishing chemical reactions, is absorbed from the air and/or is present in the chemicals added to the solvent to mix the EP solution. Under electropolishing conditions (i.e., high voltage and high current), water can be broken down by electrolysis or other reaction conditions to create gas bubbles that can adhere to the material being electropolished. Since the electropolishing reaction generally cannot occur through the gas bubbles, the surface quality (smoothness) of the electropolished article can be compromised.

Thus, when a critical amount of water is introduced into the electropolishing electrolyte solution, the ability of the solution to electropolish tantalum and tantalum alloys may be deactivated. However, the lifespan of the electropolishing electrolyte solution can be extended or a deactivated electropolishing electrolyte solution can be reactivated by adding at least one water sequestering agent to the electrolyte. The water sequestering agent(s) can maintain and/or restore the anhydrous nature of the electropolishing electrolyte solution by essentially neutralizing any water that is introduced into the electropolishing solution.

This is illustrated schematically in FIG. 3 at 300. FIG. 3 illustrates a water molecule 310 hydrogen bonded to a polyfunctional alcohol 320, which is represented schematically. The polyfunctional alcohol 320 includes a number of hydrogen bond donors 335 and hydrogen bond acceptors. Each water molecule 310 includes one oxygen atom and two hydrogen atoms. The oxygen atom of the water molecule 310 includes two lone pairs of electrons and is thus able to readily form two hydrogen bonds 330 with two hydrogen bond donors 335. Each hydrogen atom of the water molecule 310 is capable of taking a lone pair of electrons from a hydrogen bond acceptor 345.

By hydrogen bonding to the polyfunctional alcohol 320, the water molecule is isolated so that it cannot interfere with the electropolishing process. Polyethers like PEG and PPG generally do not hydrogen bond with themselves to a large extent, which may favor hydrogen bonding with either water or the alcohols on the electrolyte solution. In addition, without being tied to one theory, it is believed that hydrogen bonding with water as opposed to alcohol may be thermodynamically preferred in electropolishing electrolyte due to the number of possible hydrogen bonds that can be formed with the two types of molecules. Alcohols can form at most three hydrogen bonds with the polyfunctional alcohols used as water sequestering agents as described herein while water can form four or more. This means that hydrogen bonding with water is preferred by at least about 18 kJ/mol as compared to hydrogen bonding with alcohol. As a result, the water sequestering agent may truly "scavenge" water in the electrolyte solution.

Higher order hydrogen bonding between the water molecule 310 and the polyfunctional alcohol 320 is also possible, which may further favor hydrogen bonding to water. For example, it is possible for a single hydrogen atom to participate in two hydrogen bonds, rather than one. This type of bonding is called "bifurcated" Likewise, oxygen atoms are likely to form bifurcated hydrogen bonds.

Suitable examples of water sequestering agents include, but are not limited to, polyfunctional alcohols such as polyethers (e.g., PEG and PPG) and polyols (e.g., sugar alcohols).

PEGs are oligomers or polymer of ethylene oxide. PEGs are prepared by polymerization of ethylene oxide and are commercially available over a wide range of molecular weights from 200 g/mol to 10,000,000 g/mol. PEGs are soluble in alcohol solvent and are generally stable in acid. The basic structure of PEGs is represented below at Formula 2.

Formula 2

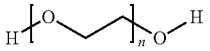

In PEGs, n can be as low as about 4 for PEG 200 or in the hundreds of thousands for very high molecular weight PEGs. PEGs are typically designated according to the average molecular weight of the polymer. For example, PEG 200 is a polymer having an average molecular weight of 200 daltons, PEG 500 is a polymer having an average molecular weight of 500 daltons, PEG 1000 is a polymer having an average molecular weight of 1000 daltons, and so on. In some nomenclatures, PEGs are also classified according to the value of n. For example, PEG 200 is often referred to as PEG 4, PEG 500 is often referred to as PEG 10, PEG 1000 is often referred to as PEG 20, and so on.

Suitable examples of PEGs that may be used herein include PEG 500, PEG 1000, PEG 2000, PEG 5000, PEG 10,000, PEG 15,000, and the like In one embodiment, the PEG is PEG 1000. PEGs are capable of sequestering water by forming hydrogen bonds that surround individual water molecules or clusters of water. When surrounded by a water sequestering agent like PEG, water molecules are generally less chemically accessible and, as such, they are believed to be less able to poison the electropolishing electrolyte solution.

PPG (aka polypropylene oxide) is a polymer of propylene glycol. PPG has many properties in common with polyethylene glycol. However, solubility in water decreases rapidly with increasing molar mass. Secondary hydroxyl groups in PPG are less reactive than primary hydroxyl groups in polyethylene glycol. PPG is generally less toxic than PEG. The basic structure of PEGs is represented below at Formula 3.

Formula 3

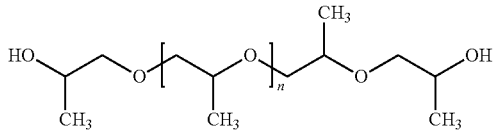

Sugar alcohols have the general formula $H(HCHO)_{n+1}H$, whereas sugars have $H(HCHO)_nHCO$. Sugar alcohols are a hydrogenated form of carbohydrate, whose carbonyl group (aldehyde or ketone, reducing sugar) has been reduced to a primary or secondary hydroxyl group (hence the alcohol). Sugar alcohols are commonly used in commercial foodstuffs in place of table sugar (sucrose), often in combination with high intensity artificial sweeteners to counter the low sweetness. In the present context, sugar alcohols have a number of hydrogen bond donor and acceptor groups that may allow them to effectively sequester water in an electropolishing electrolyte solution.

Some common sugar alcohols include, arabitol, xylitol, ribitol (5-carbon), mannitol, sorbitol (6-carbon), isomalt, maltitol, lactitol, and polyglycitol (12-carbon). Monosaccharides, disaccharides, and polysaccharaides can form sugar alcohols; however, sugar alcohols derived from disaccharides and polysaccharaides (e.g., maltitol and lactitol) are not entirely hydrogenated.

It should be noted that while the water sequestering agents like PEG, PPG, and polyols are described herein in reference to specific electropolishing electrolyte solutions and specific metallic materials, the principles described herein are applicable to any electropolishing process for any material that uses anhydrous electropolishing electrolyte solutions.

Electropolishing Methods

In one embodiment, a method for scavenging water in an electropolishing electrolyte solution is described. The method includes (1) positioning a substantially anhydrous electropolishing electrolyte solution in an electropolishing apparatus, (2) adding a first quantity of a water sequestering agent to the substantially anhydrous electropolishing electrolyte solution, and electropolishing a metal article in the substantially anhydrous electropolishing electrolyte solution in the electropolishing cell, wherein water evolved during the electropolishing process is sequestered by the water sequestering agent.

In another embodiment, a method for electropolishing a metal article is described. The method includes (1) positioning a substantially anhydrous electropolishing electrolyte solution in an electropolishing cell, wherein the electropolishing cell includes a reservoir configured to contain the substantially anhydrous electropolishing electrolyte solution, an anode and a cathode suspended in the electrolyte and connected to an electrical power supply, (2) adding a first quantity of at least one water sequestering agent to the substantially anhydrous electropolishing electrolyte solution, wherein the at least one water sequestering agent includes at least one of polyfunctional alcohol, (3) connecting a metal article to an anode and positioning the metal article in the reservoir in the substantially anhydrous electropolishing electrolyte solution, and (4) running an electrical current through the substantially anhydrous electropolishing electrolyte solution via the anode and the cathode so as to electropolish the metal article, wherein water evolved during the electropolishing is sequestered by the water sequestering agent so as to preserve the substantially anhydrous electropolishing electrolyte solution.

The methods described herein may further include electropolishing at a substantially constant electrical current while monitoring voltage across the electropolishing cell, and adding a second quantity of the at least one water sequestering agent to the electropolishing electrolyte solution when the voltage exceeds a selected value. That is, as water is evolved as a by-product of the electropolishing process or as water is absorbed from the air, the capacity of the water sequestering agent may be exceeded. As the water concentration in the electropolishing electrolyte solution increases, the observed resistance of the solution may increase as the efficiency of the electropolishing process drops, leading to the need to increase the voltage in order to maintain a substantially constant current. As such, additional $P_2O_5$ may be added to scavenge the water in the electropolishing electrolyte solution and thereby restore the electropolishing electrolyte solution.

The methods described herein may employ any of the electropolishing electrolyte solutions described herein. For example, the electropolishing electrolyte solution may include about 5 volume % ("vol %") to about 7 vol % sulfuric acid and about 3 vol % to about 14 vol % methanolic hydrochloric acid. The electropolishing electrolyte solution may further include at least one water sequestering agent, as described in detail elsewhere herein.

EXAMPLES

Working Example 1

An electropolishing electrolyte solution may be prepared in the following manner:

1. Turn on chiller, wait until temperature is below 0° C.
2. Cool methanol at least 3 hours prior to mixing.
3. Measure 1600 mL of Methanol and place it in a double-walled beaker that is attached to the chiller.
4. Put a thermometer into the beaker to measure solution temperature. The temperature must be below 0° C. before proceeding to the next step.
5. Measure 130 ml of sulfuric acid and slowly pour the acid into the beaker along the edge, then stir to mix the acid thoroughly with the methanol.

Note: if temperature of solution rise above 10° C., stop adding the acid and wait for the temperature to drop below 0° C.

6. Measure 282 ml of methanolic HCl and slowly pour into the beaker along the edge. Stir solution until a vortex is formed to mix thoroughly.
7. Weigh 3 g of PEG 1000 and mix with 150 ml of the solution prepared in steps 1-6. Mix until dissolved. Add the solution containing the PEG to the rest of the solution prepared in steps 1-6. Alternatively, the approximately 3 g of PEG can be dissolved in the sulfuric acid prior to adding the sulfuric acid to the chilled methanol in step 5.
8. Pour the mixture into a storage container, close cap securely and store in refrigerator.

Working Example 2

Stents are typically electropolished at a control current a range of 1-5 Amps for 3-4 cycles of 4-12 seconds per cycle. However, these parameters are dependent on the size of the stent, how much material is removed from the stent, etc. The temperature of the electrolyte during electropolishing is kept between −10 and +5 degrees Celsius. Additional water sequestering agent (e.g., PEG) can be added at regular intervals during the electropolishing or as visual inspection of the electropolished articles indicates declining electropolishing quality.

Working Example 3

Stents were electropolished with the addition of about 1 g to 10 g PEG per 2012 ml of solution. It was discovered that the solution could electropolish approximately 60-80 stents per 3-5 g of PEG in 2012 ml of solution.

Figure 4A:
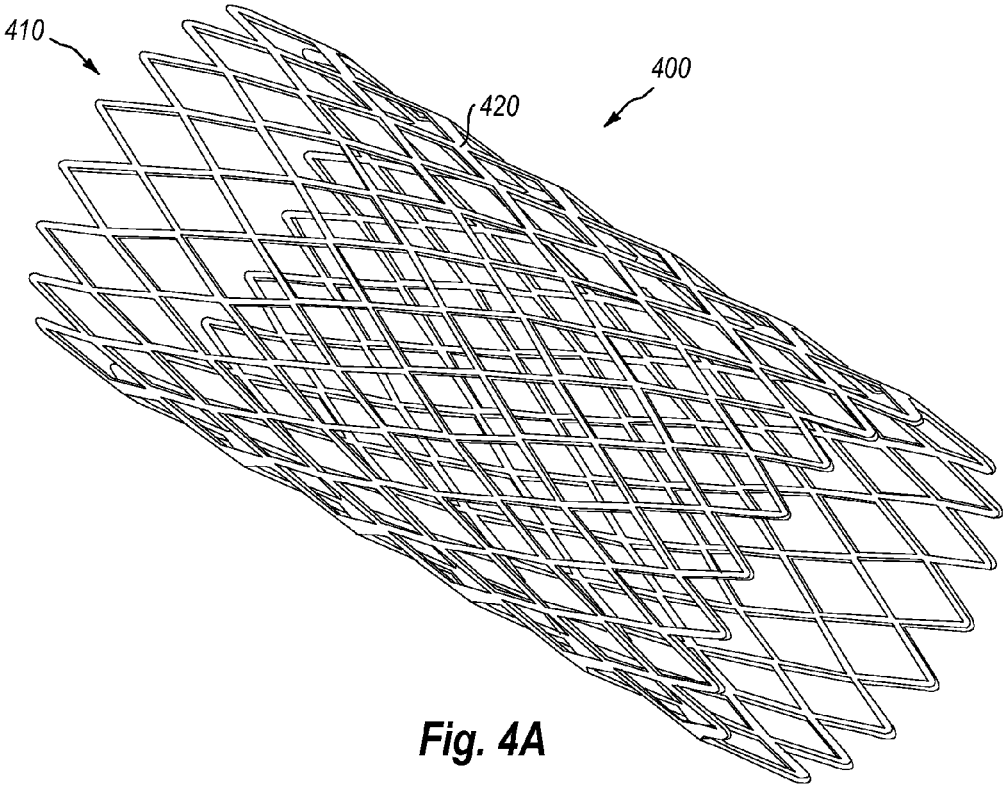
FIG. 4A is an isometric view of a stent made from a tantalum alloy according to an embodiment of the present disclosure.

Tantalum-Alloy Products, Such as Stents and Other Implantable Medical Devices As discussed above, the disclosed electropolishing solutions and methods are particularly suitable for electropolishing tantalum-based articles, such as stents. FIG. 4A is an isometric view of a stent 400 made from a tantalum alloy according to an embodiment of the present disclosure. The stent 400 includes a stent body 410 sized and configured to be implanted and deployed into a lumen of a living subject. The stent body 410 may be defined by a plurality of interconnected struts 420 configured to allow the stent body 410 to radially expand and contract. However, it is noted that the illustrated configuration for the stent body 410 is merely one of many possible configurations, and other stent-body configurations made from the inventive tantalum-alloy products disclosed herein are encompassed by the present disclosure. For example, the struts 420 may be integrally formed with each other as shown in the illustrated embodiment, separate struts may be joined together by, for example, welding or other joining process, or separate stent sections may be joined together.

The stent body 410 is made from a tantalum alloy that is composed and heat-treated to obtain one or more of certain desirable microstructural, mechanical, or chemical properties. For example, the tantalum alloy may be heat treated to modify at least one mechanical property thereof, such as ductility, yield strength, or ultimate tensile strength. It has been found that a tantalum alloy that includes tantalum, niobium, and at least one additional element selected from the group consisting of tungsten, zirconium, molybdenum, and/or at least one of hafnium, rhenium, and cerium can fulfill the mechanical and biocompatibility requirements needed for functioning as in a medical device.

The tantalum alloy includes a tantalum content of about 78 weight-percent ("wt %") to about 91 wt %, a niobium content of about 7 wt % to about 12 wt %, and a tungsten content of about 1 wt % to about 10 wt %. However, the tantalum alloy may also include other alloying elements, such as one or more grain-refining elements in an amount up to about 5 wt % of the tantalum alloy. For example, the one or more grain-refining elements may include at least one of hafnium, cerium, or rhenium. Tungsten is provided to solid-solution strengthen tantalum, and niobium is provided to improve the ability of tantalum to be drawn. The tantalum alloy is a substantially single-phase, solid-solution alloy having a body-centered cubic crystal structure. However, some secondary phases may be present in small amounts (e.g., inclusions) depending upon the processing employed to fabricate the tantalum alloy.

The composition of the tantalum alloy may be selected from a number of alloy compositions according to various embodiments. In an embodiment, the niobium content is about 9 wt % to about 10.5 wt %, the tungsten content is about 6.0 wt % to about 8 wt %, and the balance may include tantalum (e.g., the tantalum content being about 80 wt % to about 83 wt %) and, if present, other minor alloying elements and/or impurities. In a more detailed embodiment, the niobium content is about 10 wt %, the tungsten content is about 7.5 wt %, and the balance may include tantalum (e.g., the tantalum content being about 82.5 wt %) and, if present, other minor alloying elements and/or impurities. In another more detailed embodiment, the niobium content is about 10 wt %, the tungsten content is about 2.5 wt %, and the balance may include tantalum (e.g., the tantalum content being about 87.5 wt %) and, if present, other minor alloying elements and/or impurities.

In another embodiment, the niobium content is about 10.5 wt % to about 13 wt %, the tungsten content is about 5.0 wt % to about 6 wt %, and the balance may include tantalum (e.g., the tantalum content being about 80 wt % to about 82 wt %) and, if present, other minor alloying elements and/or impurities. In a more detailed embodiment, the niobium content is about 12.5 wt %, the tungsten content is about 5.8 wt %, and the balance may include tantalum (e.g., the tantalum content being about 81 wt % to about 81.5 wt %) and, if present, other minor alloying elements and/or impurities.

In a specific example, the tantalum-containing refractory metal article disclosed herein may be made from a tantalum alloy that includes about 82.5 weight percent tantalum, about 10 weight percent niobium, and about 7.5 weight percent tungsten.

In another specific example, the tantalum-containing refractory metal article disclosed herein may be made from a tantalum alloy that includes about 87.5 weight percent tantalum, about 10 weight percent niobium, and about 2.5 weight percent tungsten.

In an embodiment, the tantalum alloy may exhibit a grain microstructure including recrystallized, generally equiaxed grains characteristic of being formed by heat treating a precursor product of the stent body 410 or the stent body 410 itself, both of which may be severely plastically deformed in a drawing process. Depending upon the extent of recrystallization process, the grain microstructure may be only partially recrystallized. In some embodiments, the recrystallization process may substantially completely recrystallize the grain microstructure with the new recrystallized grains having consumed substantially all of the old deformed grains. Even when the grain microstructure is partially recrystallized, it will be apparent from microstructural analysis using optical and/or electron microscopy that the grain microstructure includes some recrystallized grains having, for example, a generally equiaxed geometry. An average grain size of the tantalum alloy may be about 10 μm to about 20 μm and, more particularly, about 13 μm to about 16 μm depending on the extent of recrystallization and the amount of the optional one or more grain-refining alloy elements in the tantalum alloy.

In other embodiments, the tantalum alloy may be stress relieved at a temperature below a recrystallization temperature of the tantalum alloy so that the grain microstructure is relatively unchanged from the as-drawn condition. Thus, in the stress-relieved condition, the grain microstructure may include essentially only non-equiaxed, deformed, cold-worked grains. However, the stress-relief heat treatment may at least partially remove at least one of hydrogen, oxygen, or oxygen from the tantalum alloy, which can detrimentally embrittle the tantalum alloy. Thus, the tantalum alloy in the stress-relieved condition may exhibit an improved ductility relative to the as-drawn condition, while the tensile yield strength and tensile ultimate tensile strength are generally unaffected by the stress-relief heat treatment.

The heat-treated refractory metal alloy from which the articles disclosed herein may be made may exhibit combination of strength (e.g., tensile yield strength and ultimate tensile strength) and ductility (e.g., percent elongation) suitable to withstand loading conditions encountered when implanted and utilized in a lumen of a living subject. The tensile yield strength may be the 0.2% offset yield strength determined in a uniaxial tensile test when no yield point is present, and the yield point if the tantalum alloy exhibits a yield point. For example, the tantalum alloy may exhibit a tensile elongation of about 9% to about 40%, a tensile yield strength of about 400 MPa to about 815 MPa, and an ultimate tensile strength of about 500 MPa to about 850 MPa as determined by, for example, tensile testing a tubular body from which the stent body may be cut from or a drawn wire in a uniaxial tensile test. In an embodiment, the tantalum alloy (e.g., about 82.5 wt % tantalum, about 10 wt % niobium, and about 7.5 wt % tungsten) may exhibit a tensile elongation of about 9% to about 40%, a tensile yield strength of about 455 MPa to about 810 MPa, and an ultimate tensile strength of about 515 MPa to about 850 MPa. In another embodiment, the tantalum alloy may exhibit a tensile elongation of about 10% to about 25%, a tensile yield strength of about 400 MPa to about 500 MPa, and an ultimate tensile strength of about 500 MPa to about 550 MPa. In one embodiment, the tantalum alloy may exhibit a tensile elongation of about 20% to about 23%, a tensile yield strength of about 450 MPa to about 500 MPa, and an ultimate tensile strength of about 500 MPa to about 550 MPa.

In an embodiment, a heat-treated refractory metal from which the articles disclosed herein may be fabricated is made having a tantalum content of about 87.5 wt %, a niobium content of about 10 wt %, and a tungsten content of about 2.5 wt % and an at least partially recrystallized grain microstructure may exhibit a tensile elongation of about 9% to about 40%, a tensile yield strength of about 400 MPa to about 800 MPa, and an ultimate tensile strength of about 500 MPa to about 850 MPa. In one embodiment, the heat-treated tantalum alloy may exhibit a tensile elongation of about 10% to about 25%, a tensile yield strength of about 400 MPa to about 500 MPa, and an ultimate tensile strength of about 500 MPa to about 550 MPa.

In an embodiment, a stress-relieved refractory metal alloy from which the articles disclosed herein may be fabricated is made having a tantalum content of about 82.5 wt %, a niobium content of about 10 wt %, and a tungsten content of about 7.5 wt % may exhibit a percent elongation of about 9% to about 15% (e.g., about 10% to about 11%), a tensile yield strength of about 650 MPa to about 850 MPa, and an ultimate tensile strength of about 700 MPa to about 850 MPa. In the stress-relieved condition, the percent elongation of the tantalum alloy may increase by at least about 100%, at least about 200%, at least about 300%, or about 200% to about 300% compared to the same tantalum alloy in the as-drawn (i.e., un-stress-relieved condition), while the tensile yield strength and ultimate tensile strength are reduced. As yield strength and ultimate tensile strength go down, the ductility of the tantalum alloy tends to increase. The reduction in tensile yield strength and ultimate tensile strength and the increase in ductility needs to be balanced, but, in general, increasing ductility tends to yield a more durable medical device fabricated from the tantalum alloy. For example, an alloy having increased ductility is less likely to crack when radially stressed. The grain microstructure may also be relatively unchanged from the as-drawn condition and may include deformed, non-equiaxed grains.

The disclosed heat-treated tantalum alloys are sufficiently radiopaque and stronger (e.g., greater yield strength) than substantially pure tantalum (e.g., commercially pure tantalum). Consequently, the struts 420 of the stent body 410 may be thinner in a radial direction than a stent made from substantially pure tantalum and having a similar configuration, while still providing the same, better, or adequate imaging characteristics under X-ray fluoroscopy and MRI. Commercially pure tantalum exhibits a relatively greater radiopacity. However, since commercially pure tantalum is much weaker than the tantalum alloys disclosed herein, a stent made from commercially pure tantalum typically could be excessively thick for structural reasons thereby resulting in the stent being excessively radiopaque and making it difficult to distinguish surrounding body tissue during imaging.

Referring still to FIG. 4A, for example, an average thickness "t" of the struts 420 of the stent body 410 in a radial direction may be about 40 μm to about 100 μm, about 60 μm to about 80 μm, about 50 μm to about 90 μm, about 50 μm to about 77 μm, about 53 μm to about 68.5 μm, or about 58 μm to about 63.5 μm, while also exhibiting the desirable disclosed combination of strength, ductility, and radiopacity as discussed hereinabove. Because the disclosed heat-treated tantalum alloys are sufficiently strong as characterized by yield strength, ultimate tensile strength, radial strength, or combinations of the foregoing mechanical properties, the average thickness "t" of the struts 420 of the stent body 410 may be made sufficiently thin to help reduce vessel injury and enhance deliverability while still having a sufficient radiopacity to be visible in X-ray fluoroscopy and MRI.

In one or more embodiments, the stent body 410 may be etched in an acid (e.g., hydrofluoric acid) to remove heat-affected zones associated with forming the struts 420 via laser cutting and/or electropolished to improve a surface finish of the stent body 410. In such embodiments, the stent body 410 may be heat treated (e.g., a stress-relief heat treatment or recrystallization heat treatment) so that at least one of hydrogen, oxygen, or nitrogen introduced to the tantalum alloy from the acid and/or the electropolishing solution is at least partially removed. Following heat treatment, the stent body 410 may include one or more etched and/or one or more electropolished surfaces, and the tantalum alloy that forms the stent body 410 may substantially free of at least one of hydrogen, oxygen, or nitrogen or include at least one of hydrogen, oxygen, or nitrogen in an amount below a threshold concentration sufficient to cause environmental cracking in the tantalum alloy, such as hydrogen that causes hydrogen embrittlement. For example, oxygen may be present in the tantalum alloy in a concentration of about 400 ppm or less (e.g., about 100 ppm to about 300 ppm) without causing embrittlement.

Figure 4B:
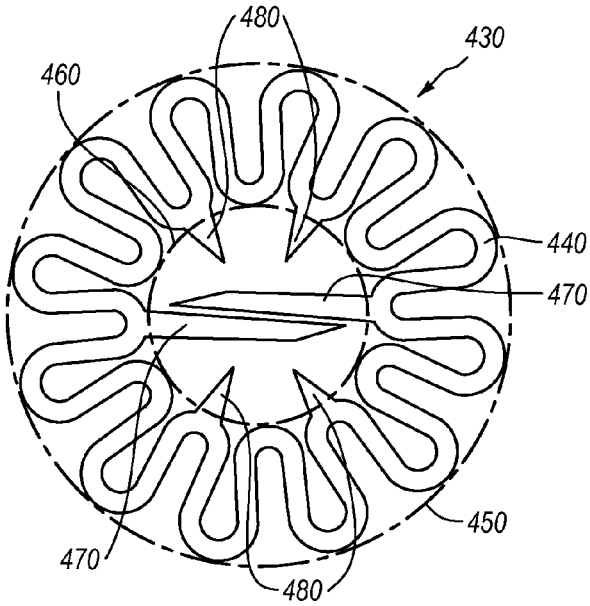
FIG. 4B is a plan view of a closure element made from any of the tantalum alloys disclosed herein according to an embodiment of the present disclosure.

Other implantable medical devices besides stents may employ a tantalum alloy exhibiting one or more of the disclosed tailored properties, such as guide wires, closure elements, pacemaker leads, orthopedic devices, embolic coils, sutures, prosthetic heart valves, mitral valve repair coils, or other medical devices or portions thereof for deploying the foregoing medical devices. For example, FIG. 4B illustrates a closure element 430 (e.g., a staple) made from any of the heat-treated tantalum alloys disclosed herein. The closure element 430 includes a body 440 defining an outer perimeter 450, an inner perimeter 460, primary tines 470, and secondary tines 480.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for sequestering water in an electropolishing electrolyte solution, comprising:

positioning a substantially anhydrous electropolishing electrolyte solution in an electropolishing cell;

adding a first quantity of a water sequestering agent to the substantially anhydrous electropolishing electrolyte solution;

electropolishing a metal article in the substantially anhydrous electropolishing electrolyte solution in the electropolishing cell at a substantially constant electrical current while monitoring voltage across the electropolishing cell, wherein water evolved during the electropolishing of the metal article is sequestered by the water sequestering agent; and adding a second quantity of the water sequestering agent to the electropolishing electrolyte solution when the voltage exceeds a selected value.

2. The method of claim 1, wherein the water sequestering agent includes at least one polyfunctional alcohol.

3. The method of claim 2, wherein the polyfunctional alcohol includes at least one sugar alcohol.

4. The method of claim 2, wherein the polyfunctional alcohol includes at least one PEG.

5. The method of claim 4, wherein the at least one PEG includes PEG 1000.

6. The method of claim 1, wherein the substantially anhydrous electropolishing electrolyte solution includes about 5 volume % ("vol %") to about 7 vol % sulfuric acid and about 3 vol % to about 14 vol % methanolic hydrochloric acid.

7. The method of claim 1, wherein the substantially anhydrous electropolishing electrolyte solution comprises:

about 79.5 vol % methanol;

about 14 vol % concentrated methanolic hydrochloric acid;

about 6.5 vol % concentrated sulfuric acid; and a quantity of PEG 1000 sufficient to sequester water introduced into the substantially anhydrous electropolishing electrolyte solution.

8. The method of claim 1, wherein the metal article is an implantable stent fabricated from a tantalum alloy.

9. The method of claim 8, wherein the tantalum alloy comprises:

about 75 to about 80 weight percent tantalum;

about 8 to about 12 weight percent niobium; and about 2 to about 10 weight percent tungsten.

10. A method for electropolishing a metal article, comprising:

positioning a substantially anhydrous electropolishing electrolyte solution in an electropolishing cell, wherein the electropolishing cell includes a reservoir configured to contain the substantially anhydrous electropolishing electrolyte solution, an anode and a cathode suspended in the electrolyte and connected to an electrical power supply;

adding a first quantity of at least one water sequestering agent to the substantially anhydrous electropolishing electrolyte solution, wherein the at least one water sequestering agent includes at least one polyfunctional alcohol;

connecting a metal article to an anode and positioning the metal article in the reservoir in the substantially anhydrous electropolishing electrolyte solution;

running a substantially constant electrical current through the substantially anhydrous electropolishing electrolyte solution via the anode and the cathode so as to electropolish the metal article while monitoring voltage across the electropolishing cell, wherein water evolved during the electropolishing is sequestered by the water sequestering agent so as to preserve the substantially anhydrous electropolishing electrolyte solution; and adding a second quantity of the at least one water sequestering agent to the substantially anhydrous electropolishing electrolyte solution when the voltage exceeds a selected value.

11. The method of claim 10, wherein the at least one polyfunctional alcohol includes at least one a sugar alcohol or at least one PEG.

12. The method of claim 11, wherein the at least one PEG includes PEG 1000.

13. The method of claim 10, wherein the substantially anhydrous electropolishing electrolyte solution includes about 5 volume % ("vol %") to about 7 vol % sulfuric acid, about 3 vol % to about 14 vol % methanolic hydrochloric acid, and a balance of methanol.

14. The method of claim 10, wherein the metal article is a stent fabricated from a tantalum alloy.

15. The method of claim 10, wherein the tantalum alloy comprises:

about 75 to about 80 weight percent tantalum;

about 8 to about 12 weight percent niobium; and about 2 to about 10 weight percent tungsten.

* * * * *